US011208282B2

(12) United States Patent
Blume

(10) Patent No.: US 11,208,282 B2
(45) Date of Patent: Dec. 28, 2021

(54) METHOD OF INITIATING A WEB WINDING PROCESS IN A WEB WINDING SYSTEM

(71) Applicant: Paper Converting Machine Company, Green Bay, WI (US)

(72) Inventor: Joseph A. Blume, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 218 days.

(21) Appl. No.: 16/690,261

(22) Filed: Nov. 21, 2019

(65) Prior Publication Data

US 2020/0180887 A1 Jun. 11, 2020

Related U.S. Application Data

(60) Provisional application No. 62/775,974, filed on Dec. 6, 2018.

(51) Int. Cl.
*B65H 18/16* (2006.01)

(52) U.S. Cl.
CPC ..... *B65H 18/16* (2013.01)

(58) Field of Classification Search
CPC ..... B65H 18/16; B65H 19/2269; B65H 20/06
See application file for complete search history.

(56) References Cited

U.S. PATENT DOCUMENTS 2,676,764 A 4/1954 Aulen
3,498,558 A 3/1970 Bradley
3,539,127 A 11/1970 Grawley
3,633,840 A 1/1972 Clark
4,723,724 A 2/1988 Bradley
4,746,076 A 5/1988 Tomma et al.
5,370,335 A 12/1994 Vigneau
6,056,229 A 5/2000 Blume et al.
6,422,501 B1 7/2002 Hertel et al.
6,695,245 B1 * 2/2004 Schultz ..... B65H 18/16 242/532.2
7,896,284 B2 * 3/2011 Morelli ..... B65H 19/2269 242/532.1

(Continued)

FOREIGN PATENT DOCUMENTS

WO 2018092167 A1 5/2018

OTHER PUBLICATIONS

International Search Report and Written Opinion for PCT/US2019/062776 dated Feb. 10, 2020.

*Primary Examiner* — Sang K Kim
(74) *Attorney, Agent, or Firm* — Thompson Coburn LLP

(57) ABSTRACT

A system has first and second winding drums and a core feeder for inserting a core into a winding nest for forming a convoluted roll. The leading edge of the web is engaged with a threading belt and directed around the first winding drum and through the winding nest to a position where the leading edge is beyond where the core feeder inserts the core into the winding nest thus providing an excess portion of the web between the leading edge and the core feeder core insertion position. A thread-up core is inserted into the winding nest and rotated with the winding drums so that the excess portion moves around the thread-up core. The leading edge is separated from the threading belt, the excess portion of the web is wound around the thread-up core, and the web from the supply is wound around the thread-up core.

45 Claims, 13 Drawing Sheets

(56) References Cited

U.S. PATENT DOCUMENTS

| | | | | |
|---|---|---|---|---|
| 9,056,742 | B2 | 6/2015 | Schwamberger et al. | |
| 9,340,386 | B2 | 5/2016 | Schwamberger et al. | |
| 2004/0061021 | A1 | 4/2004 | Butterworth | |
| 2006/0208127 | A1 | 9/2006 | Tsai | |
| 2008/0271869 | A1 | 11/2008 | Tsai | |
| 2008/0283656 | A1* | 11/2008 | Gelli | B65H 19/2269 242/521 |
| 2008/0290207 | A1* | 11/2008 | Gelli | B65H 19/2269 242/521 |
| 2009/0272835 | A1* | 11/2009 | Benvenuti | B65H 19/2269 242/521 |
| 2009/0302146 | A1* | 12/2009 | Morelli | B65H 19/2269 242/526 |
| 2010/0101185 | A1 | 4/2010 | Maddaleni et al. | |
| 2010/0294875 | A1 | 11/2010 | Tsai | |
| 2013/0068874 | A1 | 3/2013 | Schwamberger et al. | |
| 2017/0253448 | A1 | 9/2017 | Mellin | |
| 2018/0179007 | A1 | 6/2018 | Seymour | |

* cited by examiner

METHOD OF INITIATING A WEB WINDING PROCESS IN A WEB WINDING SYSTEM

CROSS-REFERENCE TO RELATED APPLICATIONS

This application claims priority benefit of U.S. provisional patent application Ser. No. 62/775,974, entitled "Method of Initiating a Web Winding Process in a Web", filed Dec. 6, 2018, the disclosure of which is incorporated by reference herein.

BACKGROUND

The disclosure is directed to a method of initiating a web winding process in a web winding system. In particular, the disclosure is directed to using a threading belt of the web winding system to position a leading edge of a web relative to the winding nest to form an excess portion of the web. A thread-up core may be introduced into the winding nest and the excess portion of the web may be wound on the core while simultaneously drawing the main portion of the web through the winding nest. Once the main portion of the web is drawn into a normal operating position in the winding nest, the thread-up core with its windings may be cut from the web and removed. A successive core may then be introduced and normal operation of the web winding system started.

This process eliminates the need for the operator to enter the guards of the machine and manually operate the threading belt in the winding nest and otherwise perform any manual steps to initiate the web winding process. This in turn decreases set-up time and increases safety.

In one example, the web winding system may be a winding machine that winds a web convolutely around a core to form a log. The web material may be provided from an unwinder. The log may be for toilet paper or paper towels.

DETAILED DESCRIPTION

Figure 1:
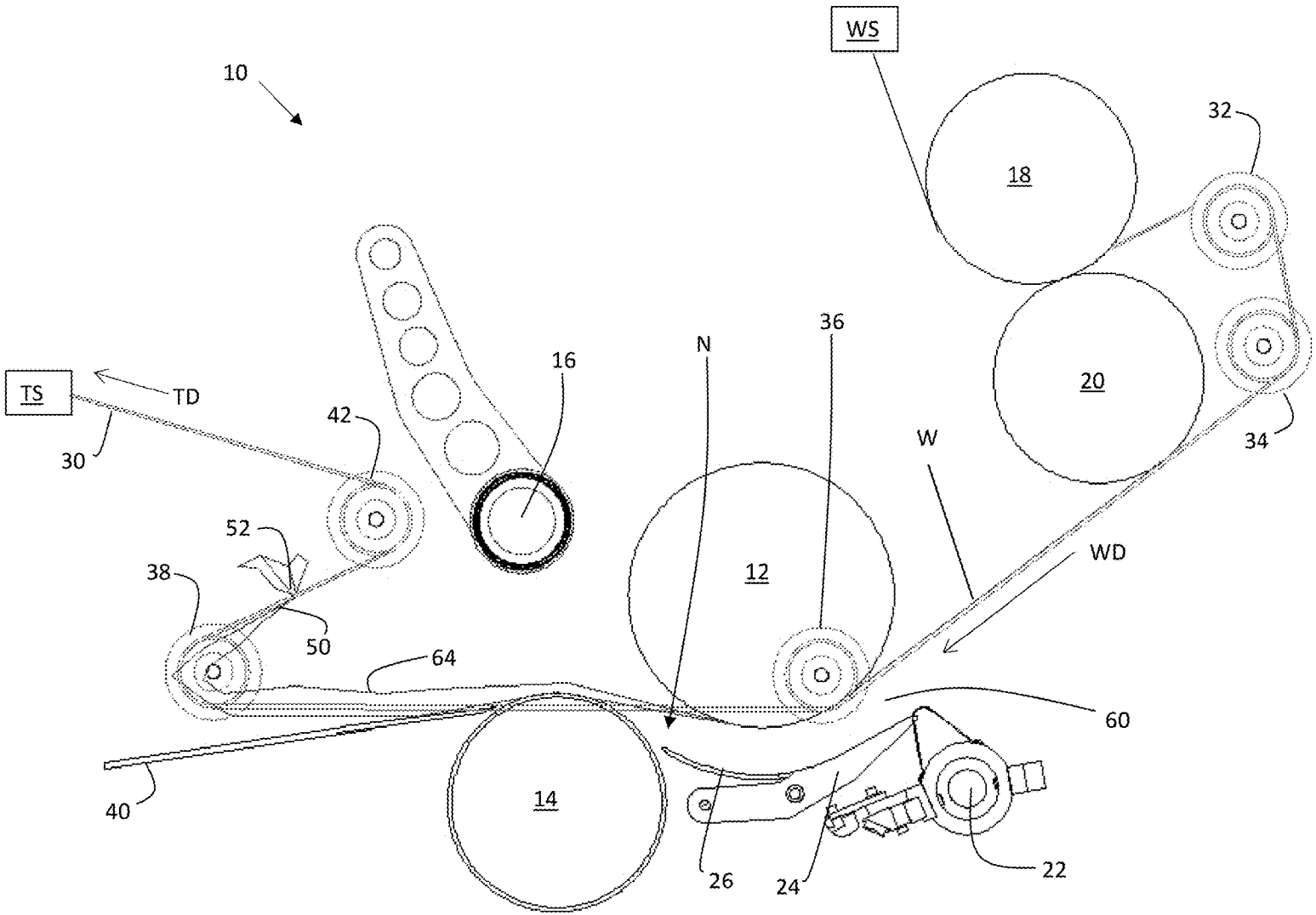
FIG. 1 shows a partial view of an exemplary winding nest where a threading belt of the web winding machine draws a leading edge of the web material through the winding nest to a position where the leading edge is positioned beyond a position where a core feeder of the web winding system inserts a core.

By way of example and not in any limiting sense, a web winding system 10 may have an upper winding drum 12, a lower winding drum 14, and optionally, a rider roll 16. While the description that follows uses the term upper winding drum and lower winding drum, this terminology is used only for ease of illustration and with reference to the orientation shown in the drawings, and is not to be construed in any limiting sense. The rider roll 16 may be moveable toward and away from the lower winding drum 14. The upper and lower winding drums 12,14 may rotate about their respective center axes. The upper winding drum 12 may be rotate in a stationary position within the frame of the machine 10. The lower winding drum 14 may move relative to the upper winding drum 12 within the frame of the machine 10. The upper winding drum 12, the lower winding drum 14, and the rider roll 16 may in part define a winding nest N of the web winding system 10. In normal winding operations, web material W from a web supply is drawn around the bottom surface of the upper winding drum 12 and wound around a core in the winding nest N. Lower draw rolls 18,20 may be provided to direct the web material W from the web supply WS to the winding nest N. The winding system 10 may also have a core feeder 22 adapted and configured to insert a core into the winding nest N. The core feeder 22 may insert cores into the winding nest on a cradle 24. The cores may travel on the cradle 24 from a core insertion position along the cradle with rotation of the upper winding drum to a position where the core may be rotated by rotation of the lower and upper winding drum. A transfer plate 26 may be provided in the path of travel of the core from the cradle 24 to a winding position between the upper and lower winding drums 12,14 and the rider roll 16. In the winding position, the core and forming log may be contacted by the upper winding drum 12, the lower winding drum 14, and the rider roll 16. The rider roll 16 may be configured to move away from the upper and lower winding drums 12,14 in an arcuate, linear and/or compound fashion to accommodate diameter growth of the log during the winding cycle.

A web threading system TS of the winding system may be provided on frame members supporting the upper and lower winding drums 12,14 and other winding system equipment. The threading system TS may include a threading belt 30 and a plurality of guide pulleys upon which the threading belt travels. The pulleys may define a threading direction TD for the threading belt. The threading direction TD may correspond to the direction of travel WD of the web material during normal winding operations. In particular, as shown in the drawings, the threading direction TD includes passing the threading belt 30 about threading pulleys 32,34 associated with the lower draw rolls 18,20, a threading pulley 36 associated with the upper winding drum 12, a threading pulley 38 at a log discharge gate 40 downstream of the winding nest, and a threading pulley 42 associated with the return of the threading belt towards the starting location and/or drive of threading belt in the threading system TS.

In order for the threading belt 30 to draw the web material around the bottom surface of the upper winding drum 12 and through the winding nest N, the rider roll 16 may be moved vertically (in the drawings) to a position (for instance, FIG. 1) to allow clearance for the web W to conform around the bottom surface of the upper winding drum and the upper surface of the lower winding drum 14. So while the drawings show the threading belt passing across the axial face of the upper and lower winding drum, it should be appreciated that the threading belt draws the web around the cylindrical faces of the upper and lower winding drum and in conformance thereto while the threading belt passes across the axial face of the drums.

Figure 7:
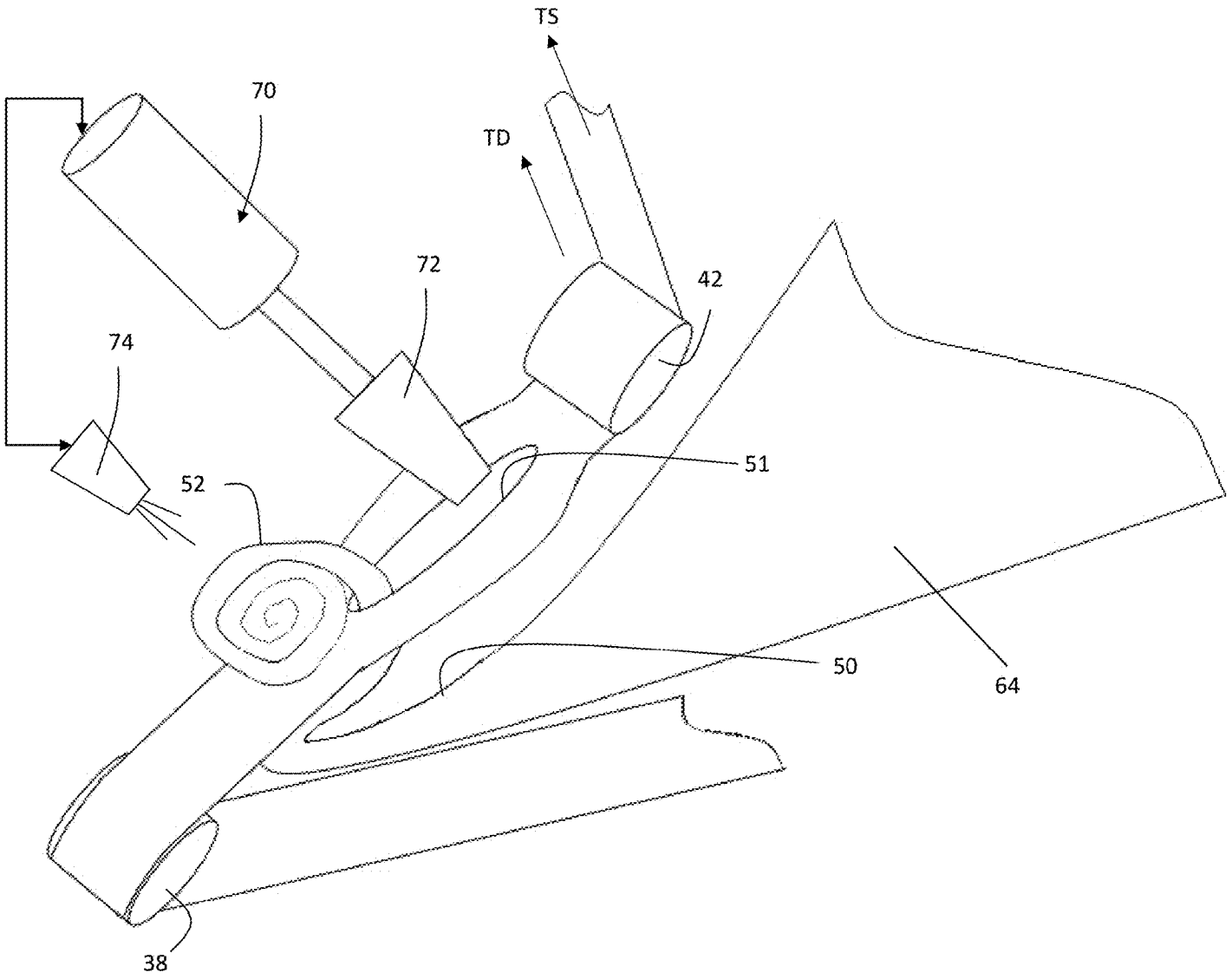
FIG. 7 shows a partial view of the leading edge of the web material engaged with the threading belt and an actuator engaging an opening in the threading belt to facilitate separation of the leading edge of the web material from the threading belt.
Figure 8:
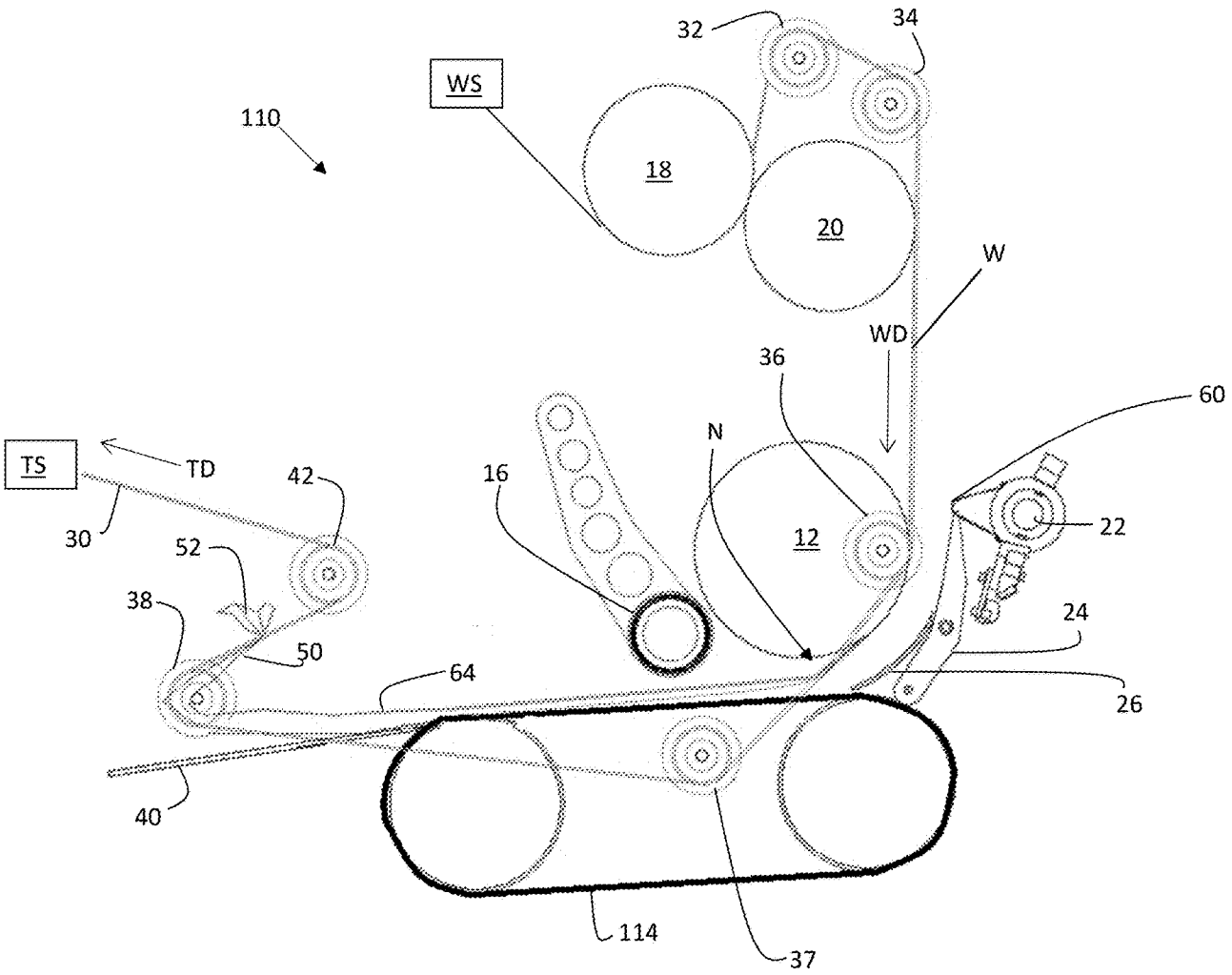
FIG. 8 shows a partial view of an alternate embodiment of an exemplary winding nest where a threading belt of the web winding machine draws a leading edge of the web material through the winding nest to a position where the leading edge is positioned beyond a position where a core feeder of the web winding system inserts a core.
Figure 9:
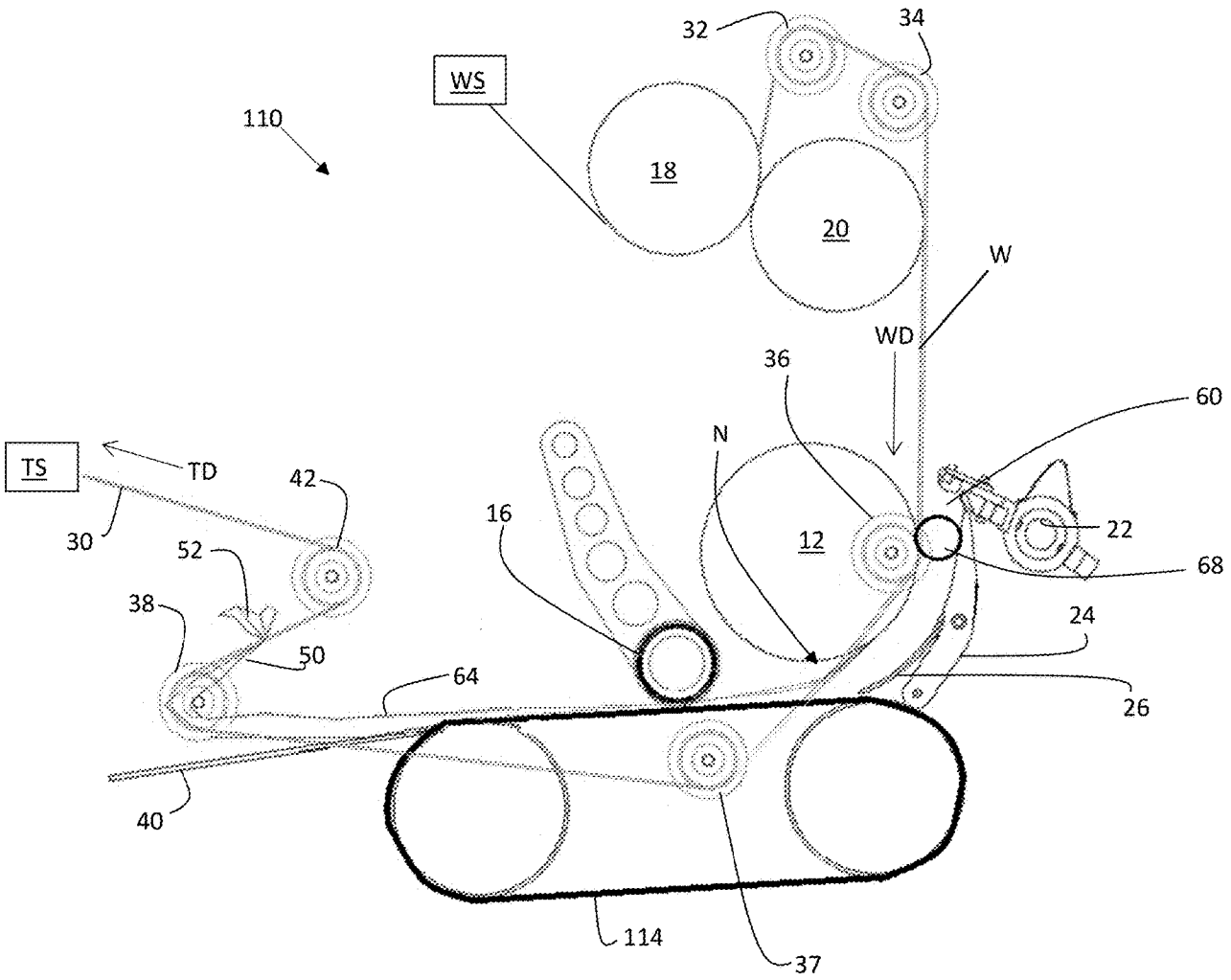
FIG. 9 shows a partial view of an exemplary winding nest where a rider roll is positioned relative to a belt to form a nip with the web therebetween and a core inserted from the core feeder.
Figure 10:
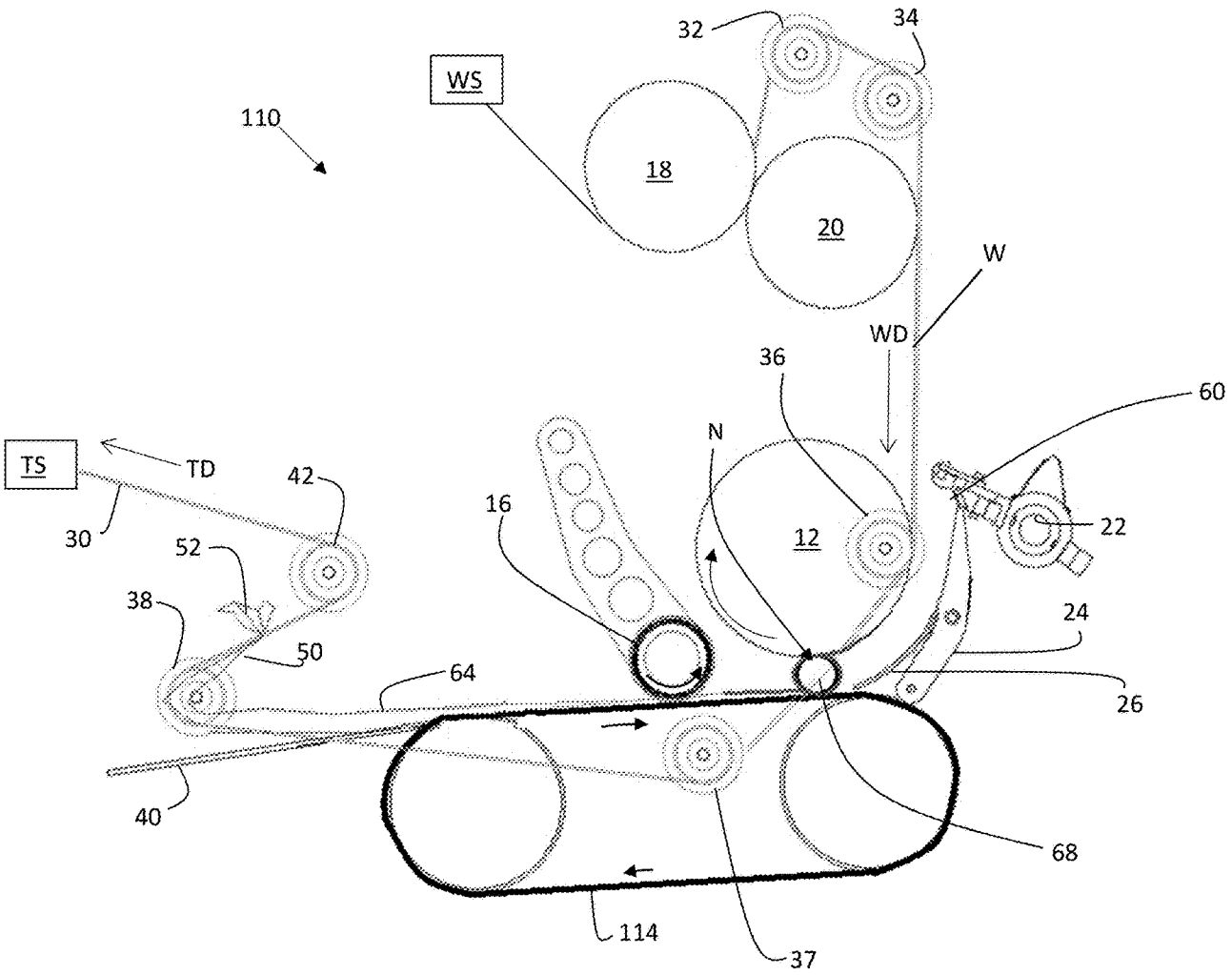
FIG. 10 shows a partial view of an exemplary winding nest where the rider roll and the belt are rotated to draw an excess portion of the web toward the core and the core begins winding the web material from the web supply around the core as the excess portion of the web is wound around the core.

In a first step, a leading edge 50 of the web material W from the supply WS of web material is engaged with the threading belt 30. The leading edge 50 of the web material may be acutely angled relative to the length of the web. So the leading edge 50 of the web material may be tapered across the width edge with a pointed portion. The pointed portion of the leading edge may be engaged with the threading belt 30. For instance, the threading belt may be provided with a hole or slot 51, and the pointed portion of the leading edge 50 may be inserted in the hole or slot in the threading belt. The pointed portion of the leading edge 50 of the web material may be formed into a knot 52 and then the knot may be directed through the hole 51 to engage the leading edge 50 of the web W with the threading belt 30. The knot 52 may be formed by tying or securing the leading edge 50 of the web material to threading belt, or by taking a section of the leading edge of the web material, bunching up the section or doubling the section back over itself to form the knot, for instance, as shown in FIG. 7, and extending the knot through the threading belt hole or slot. A loop may be provided in the threading belt and the pointed portion may be directed through the loop and may be formed in a similar style knot about the loop. The knot 52 may be formed to allow the knot to be easily undone when the web W is pulled in a direction opposite of the threading direction TD.

In one step of the disclosed method, the threading belt 30 may be operated to draw the leading edge 50 of the web material W through the web winding system in the direction WD corresponding to the path of the web material during normal operation of the winding system. In operating the threading belt 30, the web material W may be directed around the upper winding drum 12 and the lower winding drum 14 and through the winding nest N to a position where the leading edge 50 of the web material is beyond a core insertion position 60 where the core feeder 22 inserts the core into the winding nest N. In operating the threading belt 30, the leading edge 50 of the web material W may be directed past the core insertion position 60 to form an excess portion of the web material 64 between the leading edge of the web material and the core feeder core insertion position. In one example, the leading edge 50 of the web material may be drawn to a position beyond the lower winding drum 14 in the threading direction TD. For instance, the threading belt 30 may be operated so that the knot 52 of the leading edge 50 of the web material W moves toward the threading belt pulley 38 of the discharge gate 40. In a further example, the threading belt 30 may be operated to direct the leading edge 50 and excess portion 64 of the web material W away from and then back towards the winding nest N to create slack in the excess portion. For instance, the threading belt 30 may be operated so that the knot 52 of the leading edge 50 passes around the threading belt pulley 38 associated with the discharge gate 40 and is positioned between the threading belt pulley 38 associated with the discharge gate and the threading belt pulley 42 associated with the return. Thus, the threading belt 30 may be operated to move the leading edge 50 of the web away from the winding nest N and then upward and back toward the winding nest. This may create slack in the excess portion 64 of the leading edge 52 of the web material W and position the knot 52 for separation from the threading belt 30. Once the leading edge 50 of the excess portion 64 of the web W and/or the knot 52 is in the desired position relative to the core insertion position 60, operation of the threading belt 30 in the threading direction TD may be paused.

Figure 2:
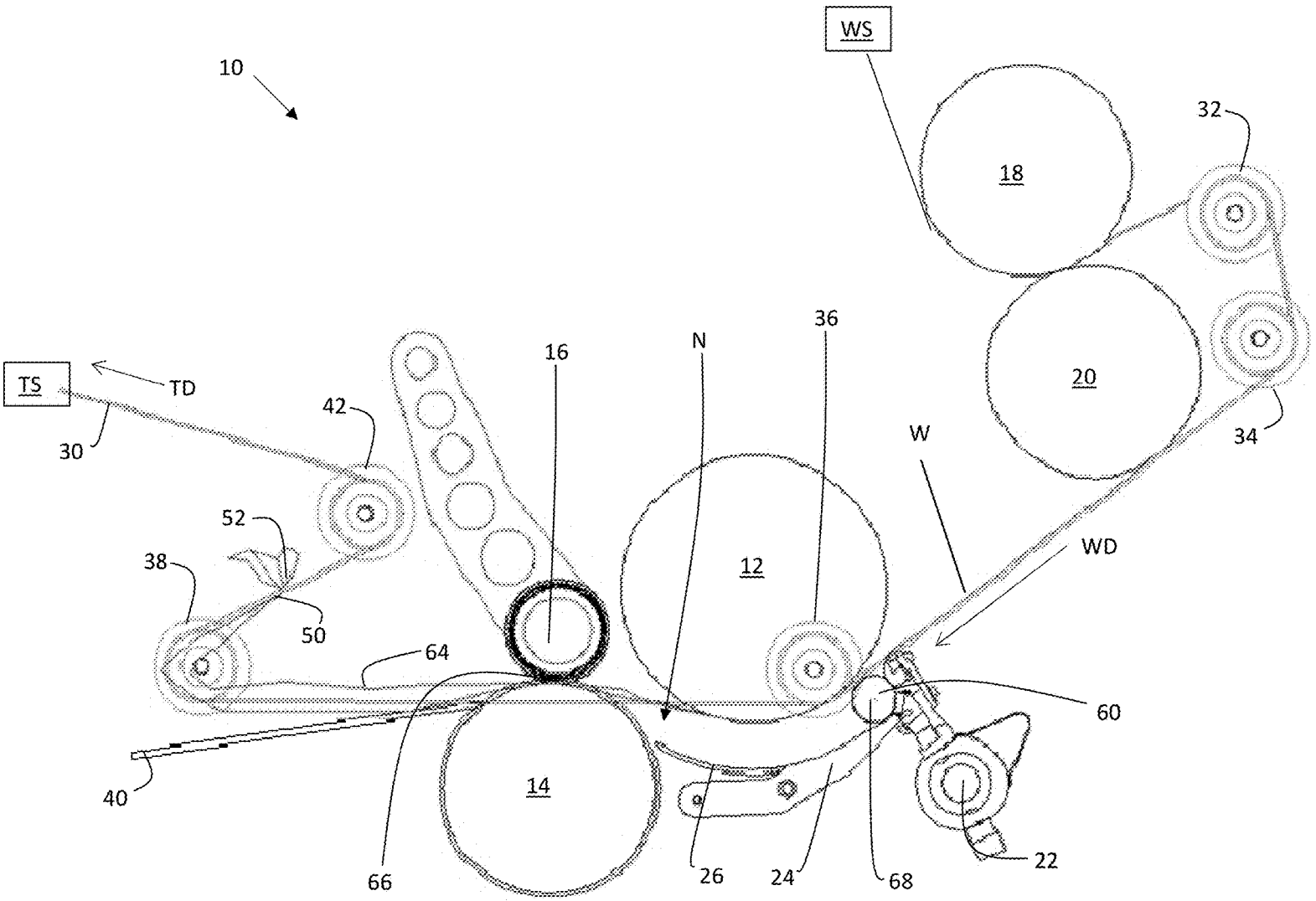
FIG. 2 shows a partial view of an exemplary winding nest where a rider roll is positioned relative to a lower winding drum to form a nip with the web therebetween and a core inserted from the core feeder.

In an optional step (e.g., shown in FIG. 2), a nip 66 may be formed between the rider roll 16 and the lower winding drum 14 with the excess portion 66 of the web material W between the rider roll and the lower winding drum. For instance, the rider roll 16 may be lowered toward the lower winding drum 14. The excess portion 64 of the leading edge 50 of the web W may be held in position against the rider roll 16 and the lower winding drum 14. The rider roll may have a resilient band slightly higher than a stop ring gap on the lower winding drum end to allow the knot to pass through the nip while providing tautness in the excess portion of the leading edge of the web material.

Figure 3:
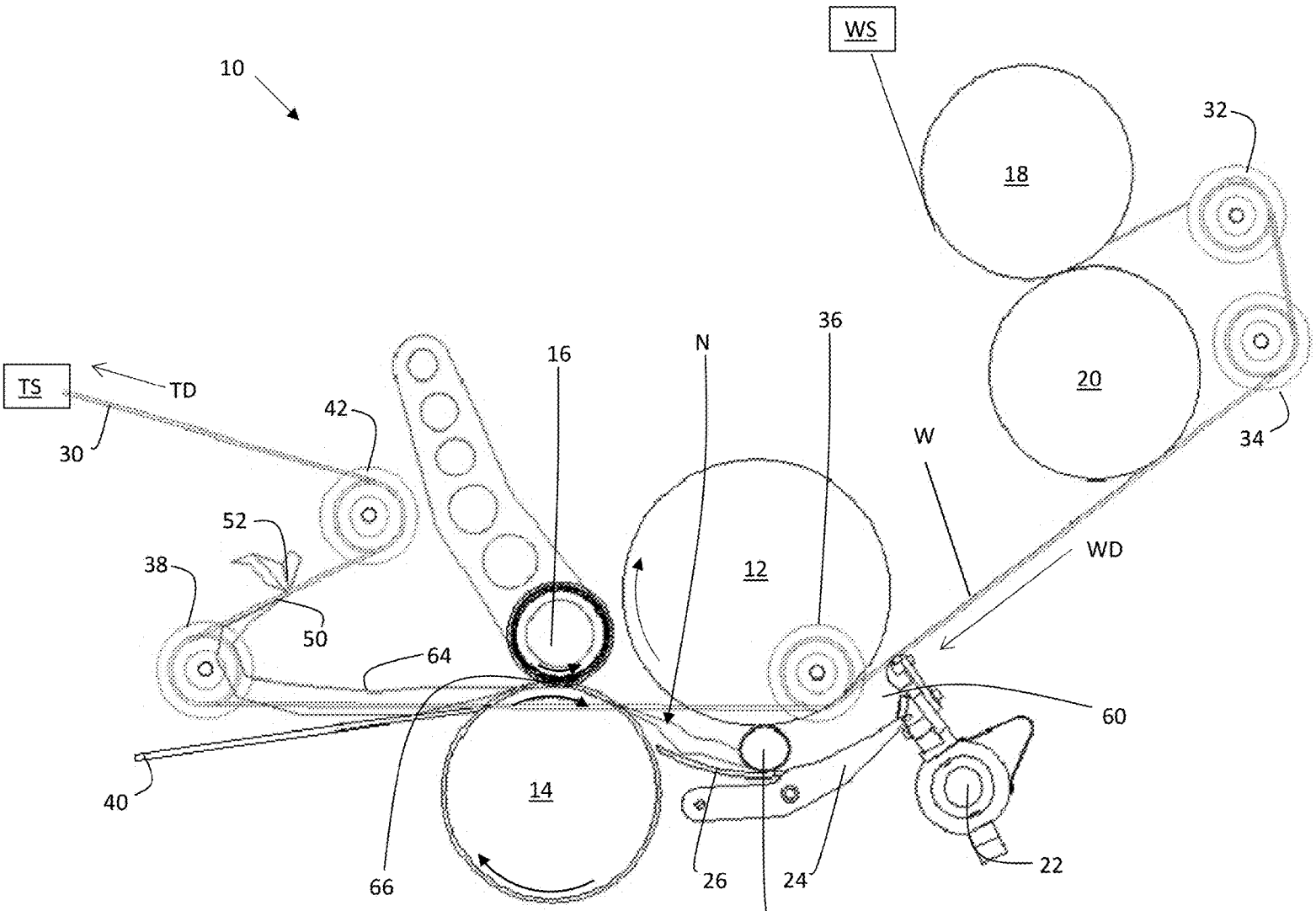
FIG. 3 shows a partial view of an exemplary winding nest where the rider roll and the lower winding drum are rotated to draw an excess portion of the web toward the core and the core begins winding the web material from the web supply around the core as the excess portion of the web is wound around the core.

In another step, which may be performed before, after, or concurrently with the above step of forming the nip 60 with the rider roll 16 and lower winding drum 14 (see, e.g., FIG. 3), a thread-up core 68 may be inserted into the winding nest N from the core feeder 22. The excess portion 64 of the web may be wound with the thread-up core 68 as will be described in greater detail below. A bonding agent may be applied to an exterior surface of the thread-up core 68. The bonding agent may be applied to the exterior surface of the thread-up core 68 only in the area of the core to be wound with the excess portion 64 of the web material W. For instance, with an acutely angled leading edge 50 of the web material W, the position on the core where the pointed portion or edge of the taper may be wound around the thread-up core 68 for the beginning wraps around the thread-up core may only have the bonding agent. By way of example, the bonding agent may be glue, a paper adhesive, or water.

Figure 4:
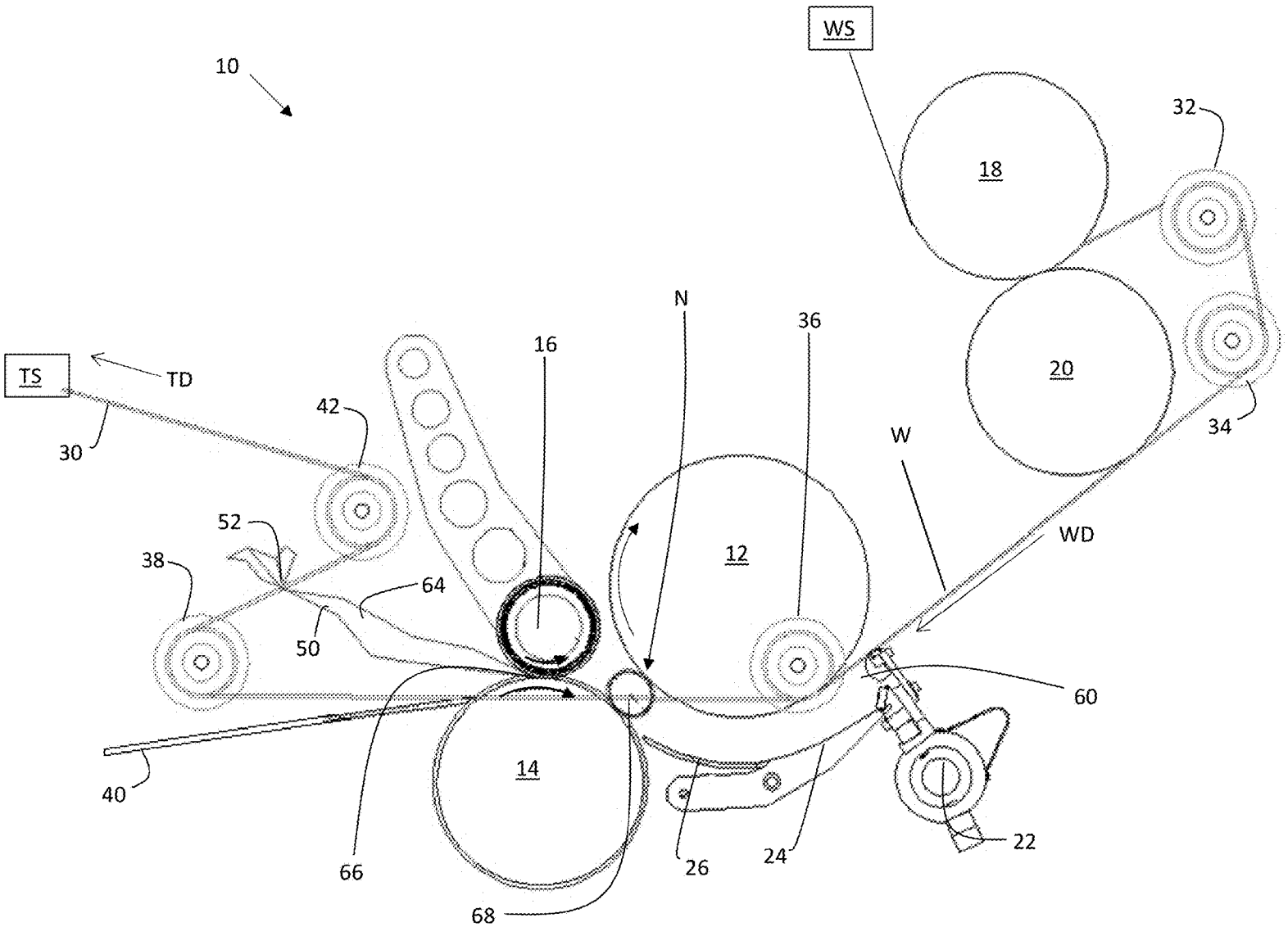
FIG. 4 shows a partial view of an exemplary winding nest where winding continues with the core between the upper winding drum and lower winding drum.
Figure 5:
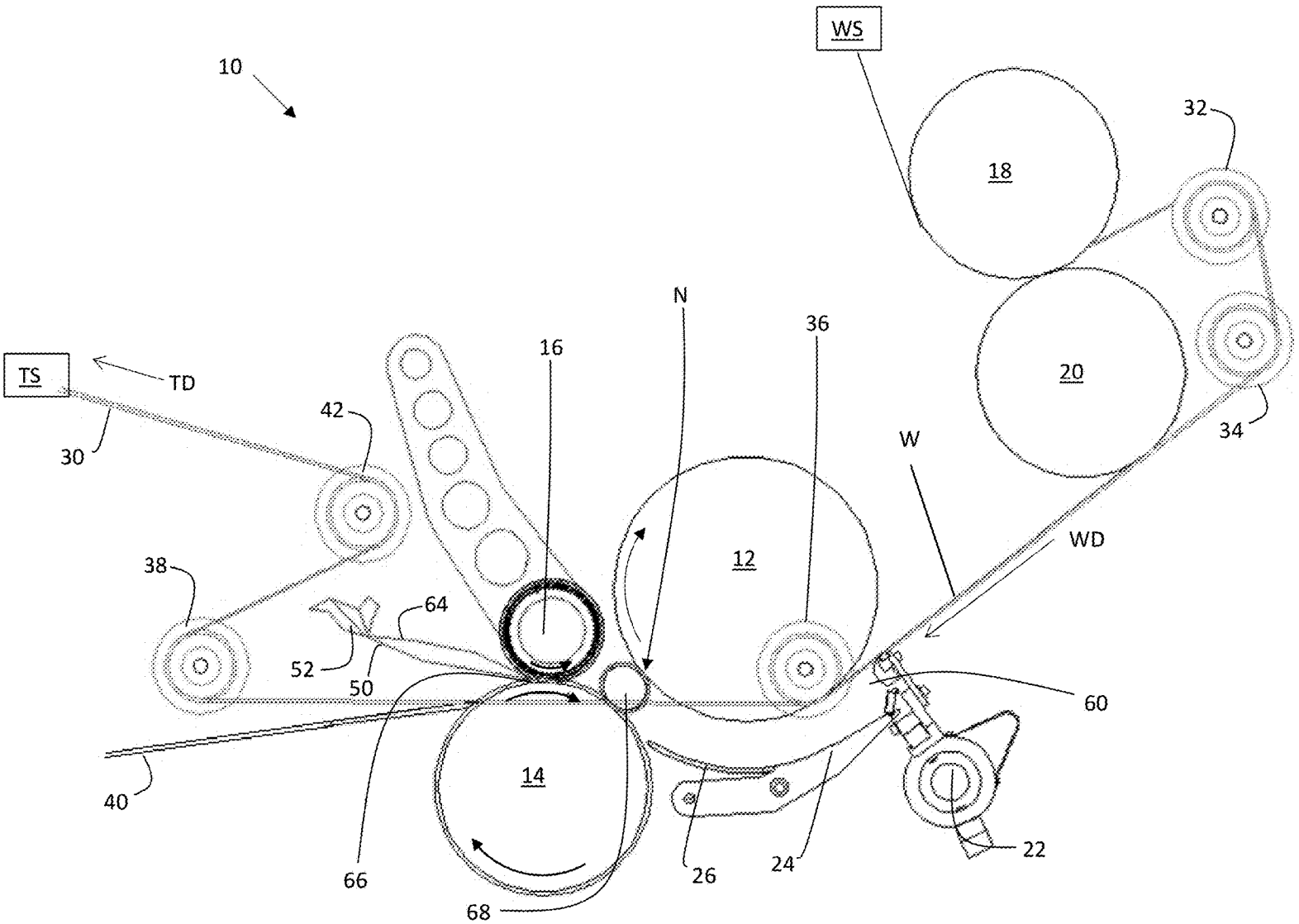
FIG. 5 shows a partial view of an exemplary winding nest where rotation of the core causes the leading edge of the excess portion of the web to separate from the threading belt with the excess portion of the web being held taut in the nip of the rider roll and lower winding drum and the core.

While winding the excess portion 64 of the leading edge 50 of the web material W around the thread-up core 68, the rider roll 16 may rotate in a direction opposite to the direction of rotation of the rider roll during normal winding operation (see, e.g., FIGS. 4 and 5). The excess portion 64 of the leading edge 50 of the web material W may be in effect metered between the rider roll 16 and the lower winding drum 14 so as to not tangle with items in the winding nest N, for instance, the core feeder 12, cradle 24, or transfer plate 26. The rider roll 16 may be rotated relative to the lower winding drum 14 with the excess portion 64 passing through the nip 66 of the rider roll and the lower winding drum. This allows the excess portion 64 to move toward and around the thread-up core 68 as the thread-up core rotates. The web winding system 10 may be operated intermittently to draw the slack of the excess portion through the nip 66 of the rider roll 16 and the lower roll 14 in a more controlled fashion, as may be desired. The thread-up core 68 may be rotated between the lower winding drum 14 and the upper winding drum 12 to draw the slack and then the excess portion 64 of the leading edge 50 of the web material W around the thread-up core 68. The thread-up core 68 may be positioned in the winding nest N so the rider roll 16 provides the nip 60 with the lower winding drum 14 for backwinding the excess portion 64 around the thread-up core in a position away from the rider roll and between the lower winding drum and upper winding drum. Alternatively, rather than forming the nip between the rider roll and the lower winding drum, the rider roll may be maintained in a raised position relative to the lower winding drum, and the thread-up core 68 may be rotated between the lower winding drum 14 and the upper winding drum 12 to draw the slack and then the excess portion 64 of the leading edge 50 of the web material W around the thread-up core 68.

In one aspect of the process, which may be performed as desired, an actuator 70 may be provided in the threading direction TD as shown in FIG. 7. The actuator 70 may be provided in a position in the threading direction TD corresponding to the desired position of the knot 52 when the threading belt 30 is operated to move the leading edge 50 of the web material away from the winding nest N and then upward and back toward the winding nest. The actuator position may also correspond to where the leading edge 50 of the excess portion 64 of the web W and/or the knot 52 is in the desired position relative to the core insertion position 60. The actuator 70 may be actuated to open up the hole 51 in the threading belt 30 to facilitate separating the knot from the threading belt. The actuator 70 may comprise a linear actuator (e.g., pneumatic, hydraulic, electronic) having an cone-shaped operator 72 that is shaped to engage the hole 51 of the threading belt 30 and spread the hole open to allow the knot to be released from the threading belt. A sensor 74 may be used to detect the location of the knot 52 as the threading belt 30 is operated. Operation of the threading belt (automatic via a control or machine operator operation) may be paused when the sensor 74 senses that the knot 52 is in the desired position to allow the operator 72 of the actuator 70 to engage the hole in the threading belt. The threading belt hole 51 may be sufficiently sized so that the operator 72 may engage the hole without interfering with the knot. The actuator 70 may be operated (automatic via a control or machine operator operation) when the hole in the belt is aligned with the operator. Operation of the actuator 70 may be performed in conjunction with the steps described herein. In the alternative, the actuator may directly engage the knot and force at least a portion of the knot through the hole in the threading belt.

Continued rotation of the thread-up core 68 with the lower winding drum 14 and the upper winding drum 12 may then cause the leading edge 50 of the web material W to separate from the threading belt 30. In this process, the rotation of the thread-up core 68 allows for winding the excess portion 64 of the web material W around the thread-up core while winding the web material from the supply WS of web material around the thread-up core. In one aspect, rotating the thread-up core 68 with the lower drum 14 and the upper winding drum 12 may allow tearing the web adjacent to the knot 52, so the knot is retained in the threading belt 30. In another aspect, rotating the thread-up core 68 with the lower winding drum 14 and the upper winding drum 12 pulls the knot 52 away or unties the knot from the threading belt 30. In this scenario, the knot 52 is wound with the excess portion 64 of the web material W around the thread-up 68 core while winding the web material from the supply of web material around the thread-up core.

Figure 6:
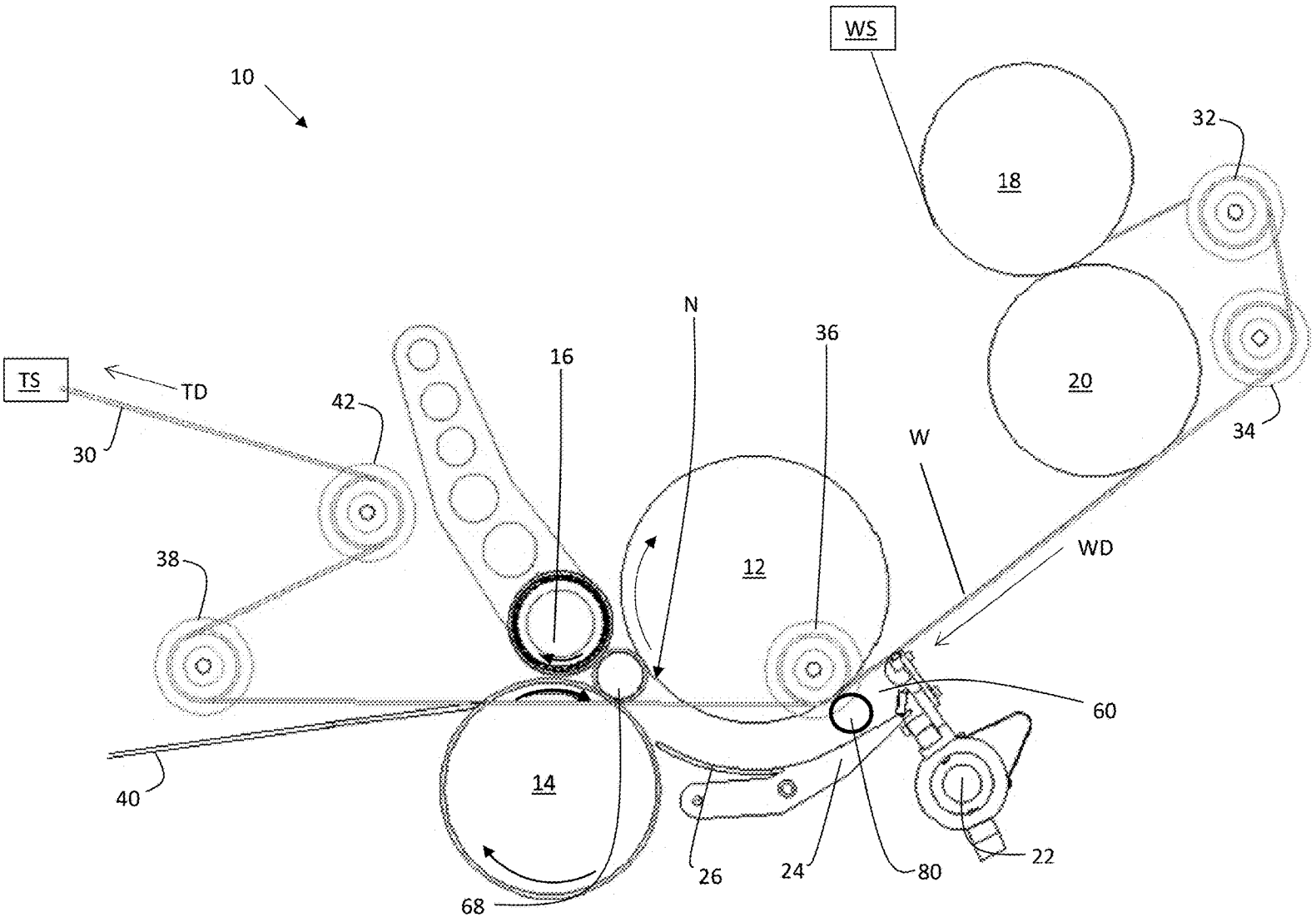
FIG. 6 shows a partial view of an exemplary winding nest where winding continues until the main portion of the web is drawn to the winding nest at which time the rider roll moves to the normal operating position to finish winding of the thread-up core and to begin normal web winding operations.

Winding the thread-up core 68 between the lower winding drum 14 and upper winding drum 12 may continue until the full width of the web W is drawn into the winding nest N. Normal operation of the winding system may then be initiated. As shown in FIG. 6, a successive core 80 may be inserted into the winding nest N from the core feeder 22 to begin normal winding operations. The thread-up core 68 may be removed after the successive core 80 is inserted into the winding nest N. Accordingly, in one aspect of operation of the winding system, inserting the successive core 80 into the winding nest N from the core feeder 22 to begin normal winding operations occurs when a full width of the web material W from the web supply WS is present across the winding nest N. In the transition from threading operations to normal winding operations when the nip is formed between the rider roll 16 and the lower winding drum 14, the rider roll may be moved to a position relative to the upper winding drum 12 and the lower winding drum to allow the winding drums to rotate the thread-up core 68 to wind the excess portion 64 of the web material W around the thread-up core and to wind the web material from the supply WS of web material around the thread-up core. When the rider roll 16 moves to the position relative to the upper and lower winding drums 12,14 to allow the thread-up core 68 to wind the excess portion 64 of the web material W around the thread-up core and to wind the web material from the supply WS of web material around the thread-up core, the rider roll may configured to rotate in a direction different from the direction when passing the excess portion 64 of the web through the nip 60 of the rider roll and the lower winding drum. Once the excess portion 64 of the leading edge 50 of the web material passes through the nip 60 of the lower winding drum 14 and the rider roll 16, the rider roll may move to position for normal winding operations, where the log is wound between the lower and upper winding drums and the rider roll.

In another aspect of the method, the threading belt 30 may be operated to draw the leading edge 50 of the web material W through the winding nest N as described before. With the knot 52 of the leading edge 50 of the web material W in a desired position, the rider roll 16 may be brought into position with the lower winding drum 14 to form the nip 60 with the excess portion of the leading edge of the web material therebetween. The thread-up core 68 may be inserted by the core feeder 22 and rotated with the lower winding drum 14 and upper winding drum 12. With the lower winding drum 14 and rider roll 16 rotating, any excess portion 64 of the leading edge 50 of the web material W may be wound around the thread-up core 68. The web winding machine 10 may be operated intermittently to control the backwinding of the excess portion 64 of the leading edge 50 of the web material W around the thread-up core 68. However, in distinction to the method described above where backwinding continues in order to separate the leading edge 50 of the web material W from the threading belt 30, backwinding may stop momentarily, and the threading belt 30 may be operated to pull the excess portion 64 of the leading edge 50 of the web material W taut with the nip 60 between the rider roll 16 and the lower winding drum 14 and to cause the leading edge of the web material to separate from the threading belt. Separation of the leading edge 50 of the web material W from the threading belt 30 may include tearing the web adjacent to the knot 52 or may include pulling the knot away from the threading belt so the knot is wound around the thread-up core. The actuator 70 may be operated before operating the threading belt 30 to spread open the hole 51 in the threading belt to allow the knot to slip through the hole once the actuator is retracted and operation of the threading belt restarts. The actuator 70 may also be operated before operating the threading belt 30 to engage the knot 51 and force at least a portion of the knot through the hole 51 in the threading belt before operation of the threading belt restarts. Once the separating of the leading edge 50 of the web material W from the threading belt 30 occurs, operation of the threading belt may stop and rotation of the thread-up core 68 may resume to wind the excess portion 64 of the web material W around the thread-up core and to draw the web material W into the winding nest from the web supply WS.

Thereafter, a successive core 80 may be inserted into the winding nest from the core feeder to begin normal winding operations. The thread-up core may be separated from the web and removed after the successive core is inserted into the winding nest. As discussed above, normal winding operations may begin when a full width of the web material from the web supply is present in the winding nest.

By way of example and not in any limiting sense, FIGS. 8-13 show another embodiment of the web winding system 110. In the description that follows, several components and features of the winding nest are the same as those shown in FIGS. 1-7, and for such components and features the same reference characters have been used. The web winding system may have a winding drum 12, a belt 114, and optionally, a rider roll 16. The web winding system may be similar to that disclosed in U.S. application Ser. No. 16/201,034, the disclosure of which is incorporated by reference. The rider roll 16 may be moveable toward and away from the belt 114. The winding drum 12 may rotate about its center axis. The winding drum 12 may be rotate in a stationary position within the frame of the machine 10. The belt 114 may move relative to the winding drum 12 within the frame of the machine 10. The winding drum 12, the belt 114, and the optional rider roll 16 may in part define the winding nest N of the web winding system 10. In normal winding operations, web material W from a web supply is drawn around the bottom surface of the winding drum 12 and wound around a core in the winding nest N. The lower draw rolls 18,20 may be provided to direct the web material W from the web supply WS to the winding nest N. The winding system 110 may also have the core feeder 22 adapted and configured to insert the core into the winding nest N. The core feeder 22 may insert cores into the winding nest on the cradle 24. The cores may travel on the cradle 24 from the core insertion position 60 along the cradle with rotation of the winding drum to a position where the core may be rotated by rotation of the winding drum and belt 114. The transfer plate 26 may be provided in the path of travel of the core from the cradle 24 to the winding position between the winding drum 12, the belt 114, and the rider roll 16. In the winding position, the core and forming log may be contacted by the winding drum 12, the belt 114, and the rider roll 16. The rider roll 16 may be configured to move away from the winding drum 12 and the belt 114 in an arcuate, linear and/or compound fashion to accommodate diameter growth of the log during the winding cycle.

A web threading system TS of the winding system may be provided on frame members supporting the winding drum 12, the belt 114 and other winding system equipment. The threading system TS may include a threading belt 30 and a plurality of guide pulleys upon which the threading belt travels. The pulleys may define a threading direction TD for the threading belt. The threading direction TD may correspond to the direction of travel WD of the web material during normal winding operations. In particular, as shown in the drawings, the threading direction TD includes passing the threading belt 30 about threading pulleys 32,34 associated with the lower draw rolls 18,20, a threading pulley 36 associated with the winding drum 12, a threading pulley 37 associated with the belt 114, a threading pulley 38 at a log discharge gate 40 downstream of the winding nest, and a threading pulley 42 associated with the return of the threading belt towards the starting location and/or drive of threading belt in the threading system TS.

In order for the threading belt 30 to draw the web material around the bottom surface of the winding drum 12 and through the winding nest N, the rider roll 16 may be moved vertically (in the drawings) to a position (for instance, FIG. 8) to allow clearance for the web W to conform around the bottom surface of the winding drum and atop the surface of the belt 114. So while the drawings show the threading belt passing across the axial face of the winding drum and pulleys of the belt, it should be appreciated that the threading belt draws the web around the cylindrical face of the winding drum and along the belt and in conformance thereto while the threading belt passes across the axial face of the winding drum and belt pulleys. For ease of illustration, the threading pulley 37 associated with the belt 114 is shown in a vertically lower position so as to not obscure the rider roll and the core, and the winding illustrations.

In a first step of the method associated with the winding system 110 of FIGS. 8-13, the leading edge 50 of the web material W from the supply WS of web material is engaged with the threading belt 30. The leading edge 50 of the web material may be acutely angled relative to the length of the web. So the leading edge 50 of the web material may be tapered across the width edge with a pointed portion. The pointed portion of the leading edge may be engaged with the threading belt 30. For instance, the threading belt may be provided with a hole or slot 51, and the pointed portion of the leading edge 50 may be inserted in the hole or slot in the threading belt. The pointed portion of the leading edge 50 of the web material may be formed into a knot 52 and then the knot may be directed through the hole 51 to engage the leading edge 50 of the web W with the threading belt 30. The knot 52 may be formed by tying or securing the leading edge 50 of the web material to threading belt, or by taking a section of the leading edge of the web material, bunching up the section or doubling the section back over itself to form the knot, for instance, as shown in FIG. 7, and extending the knot through the threading belt hole or slot. A loop may be provided in the threading belt and the pointed portion may be directed through the loop and may be formed in a similar style knot about the loop. The knot 52 may be formed to allow the knot to be easily undone when the web W is pulled in a direction opposite of the threading direction TD.

In one step of the disclosed method, the threading belt 30 may be operated to draw the leading edge 50 of the web material W through the web winding system in the direction WD corresponding to the path of the web material during normal operation of the winding system. In operating the threading belt 30, the web material W may be directed around the winding drum 12 and on top of and along the surface of the belt 114 and through the winding nest N to a position where the leading edge 50 of the web material is beyond a core insertion position 60 where the core feeder 22 inserts the core into the winding nest N. In operating the threading belt 30, the leading edge 50 of the web material W may be directed past the core insertion position 60 to form an excess portion of the web material 64 between the leading edge of the web material and the core feeder core insertion position. In one example, the leading edge 50 of the web material may be drawn to a position beyond the belt 114 and discharge gate 40 in the threading direction TD. For instance, the threading belt 30 may be operated so that the knot 52 of the leading edge 50 of the web material W moves toward the threading belt pulley 38 of the discharge gate 40. In a further example, the threading belt 30 may be operated to direct the leading edge 50 and excess portion 64 of the web material W away from and then back towards the winding nest N to create slack in the excess portion. For instance, the threading belt 30 may be operated so that the knot 52 of the leading edge 50 passes around the threading belt pulley 38 associated with the discharge gate 40 and is positioned between the threading belt pulley 38 associated with the discharge gate and the threading belt pulley 42 associated with the return. Thus, the threading belt 30 may be operated to move the leading edge 50 of the web away from the winding nest N and then upward and back toward the winding nest. This may create slack in the excess portion 64 of the leading edge 52 of the web material W and position the knot 52 for separation from the threading belt 30. Once the leading edge 50 of the excess portion 64 of the web W and/or the knot 52 is in the desired position relative to the core insertion position 60, operation of the threading belt 30 in the threading direction TD may be paused.

In an optional step (e.g., shown in FIG. 9), a nip 66 may be formed between the rider roll 16 and the belt 114 with the excess portion 66 of the web material W between the rider roll and the belt. For instance, the rider roll 16 may be lowered toward the belt 114. The excess portion 64 of the leading edge 50 of the web W may be held in position against the rider roll 16 and the belt 114. The rider roll may have a resilient band slightly higher than a stop gap on a mounting means for the belt to allow the knot to pass through the nip while providing tautness in the excess portion of the leading edge of the web material.

In another step, which may be performed before, after, or concurrently with the above step of forming the nip 60 with the rider roll 16 and the belt 114 (see, e.g., FIG. 10), a thread-up core 68 may be inserted into the winding nest N from the core feeder 22. The excess portion 64 of the web may be wound with the thread-up core 68 as will be described in greater detail below. A bonding agent may be applied to an exterior surface of the thread-up core 68. The bonding agent may be applied to the exterior surface of the thread-up core 68 only in the area of the core to be wound with the excess portion 64 of the web material W. For instance, with an acutely angled leading edge 50 of the web material W, the position on the core where the pointed portion or edge of the taper may be wound around the thread-up core 68 for the beginning wraps around the thread-up core may only have the bonding agent. By way of example, the bonding agent may be glue, a paper adhesive, or water.

Figure 11:
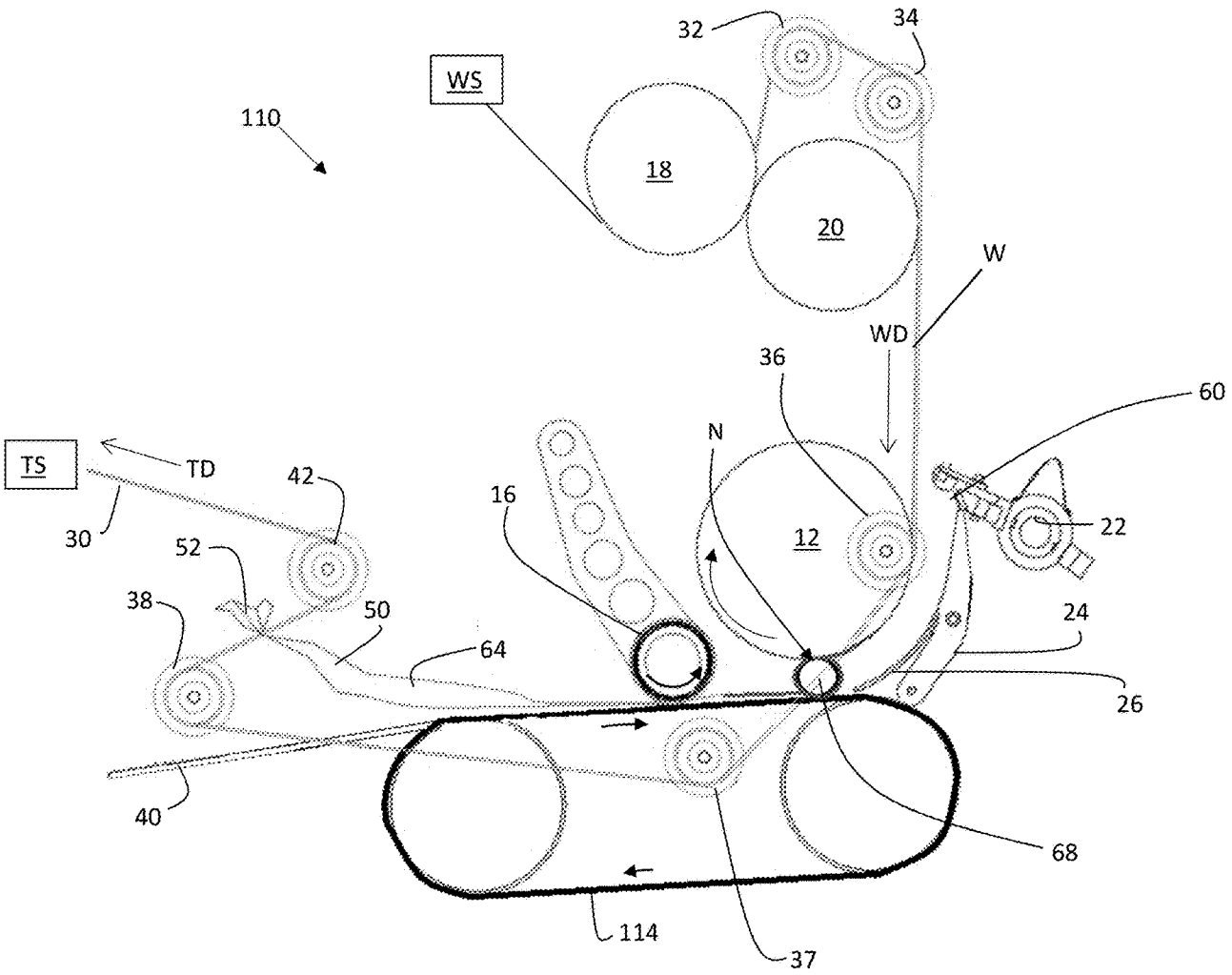
FIG. 11 shows a partial view of an exemplary winding nest where winding continues with the core between a winding drum and the belt.
Figure 12:
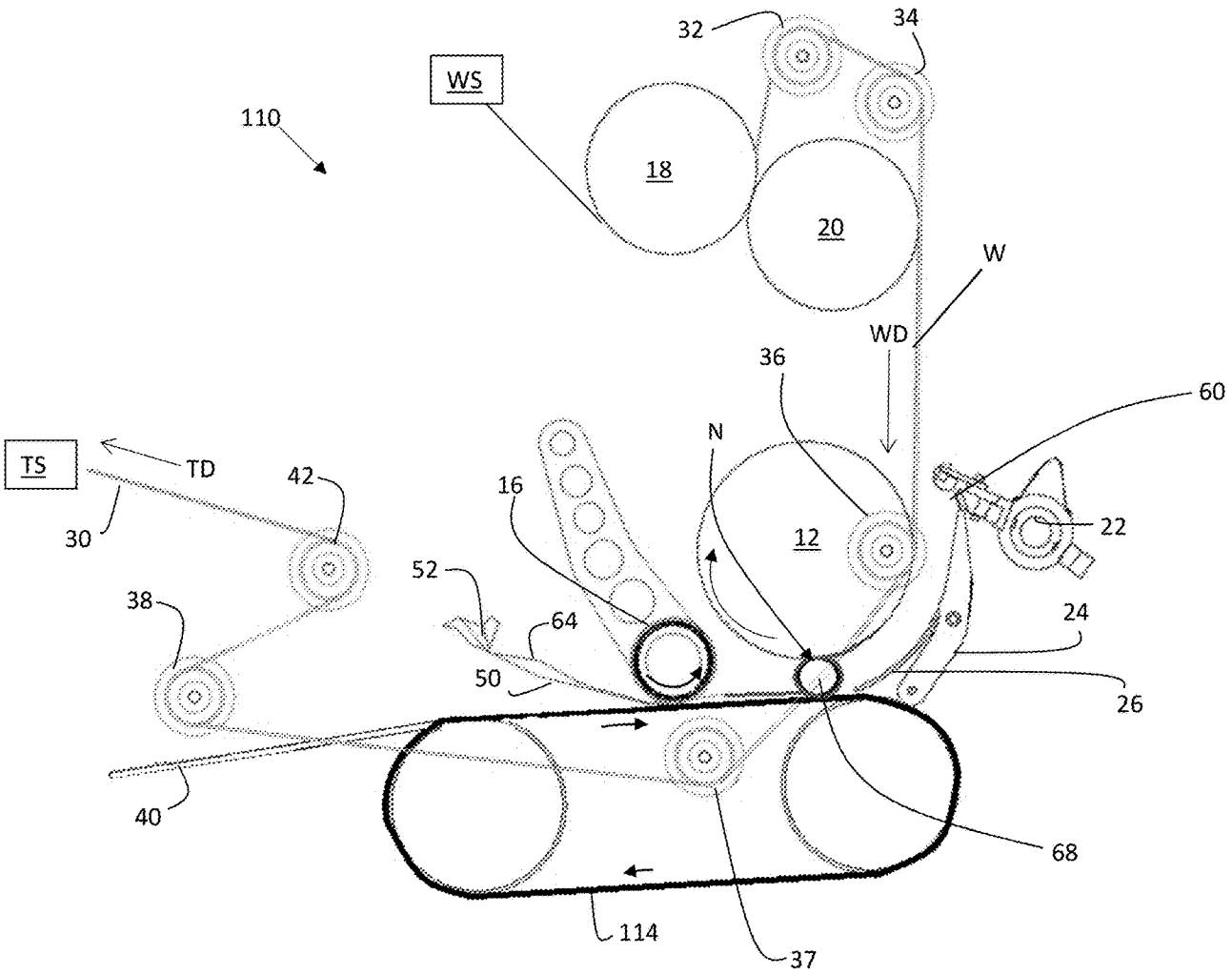
FIG. 12 shows a partial view of an exemplary winding nest where rotation of the core causes the leading edge of the excess portion of the web to separate from the threading belt with the excess portion of the web being held taut in the nip of the rider roll and the belt and the core.

While winding the excess portion 64 of the leading edge 50 of the web material W around the thread-up core 68, the rider roll 16 may rotate in a direction opposite to the direction of rotation of the rider roll during normal winding operation (see, e.g., FIGS. 11 and 12). The excess portion 64 of the leading edge 50 of the web material W may be in effect metered between the rider roll 16 and the belt 114 so as to not tangle with items in the winding nest N, for instance, the core feeder 12, cradle 24, or transfer plate 26. The rider roll 16 may be rotated relative to the belt 114 with the excess portion 64 passing through the nip 66 of the rider roll and the belt. This allows the excess portion 64 to move toward and around the thread-up core 68 as the thread-up core rotates. The web winding system 110 may be operated intermittently to draw the slack of the excess portion through the nip 66 of the rider roll 16 and the belt 114 in a more controlled fashion, as may be desired. The thread-up core 68 may be rotated between the belt 114 and the winding drum 12 to draw the slack and then the excess portion 64 of the leading edge 50 of the web material W around the thread-up core 68. The thread-up core 68 may be positioned in the winding nest N so the rider roll 16 provides the nip 60 with the belt 114 for backwinding the excess portion 64 around the thread-up core in a position away from the rider roll and between the belt and the winding drum. Alternatively, rather than forming the nip between the rider roll and the belt, the rider roll may be maintained in a raised position relative to the belt 114, and the thread-up core 68 may be rotated between the belt and the winding drum 12 to draw the slack and then the excess portion 64 of the leading edge 50 of the web material W around the thread-up core 68.

In one aspect of the process, which may be performed as desired, an actuator 70 may be provided in the threading direction TD as shown in FIG. 7. The actuator 70 may be operated as previously described.

Continued rotation of the thread-up core 68 with the belt 114 and the winding drum 12 may then cause the leading edge 50 of the web material W to separate from the threading belt 30. In this process, the rotation of the thread-up core 68 allows for winding the excess portion 64 of the web material W around the thread-up core while winding the web material from the supply WS of web material around the thread-up core. In one aspect, rotating the thread-up core 68 with the belt 114 and the winding drum 12 may allow tearing the web adjacent to the knot 52, so the knot is retained in the threading belt 30. In another aspect, rotating the thread-up core 68 with the belt 114 and the winding drum 12 pulls the knot 52 away or unties the knot from the threading belt 30. In this scenario, the knot 52 is wound with the excess portion 64 of the web material W around the thread-up 68 core while winding the web material from the supply of web material around the thread-up core.

Figure 13:
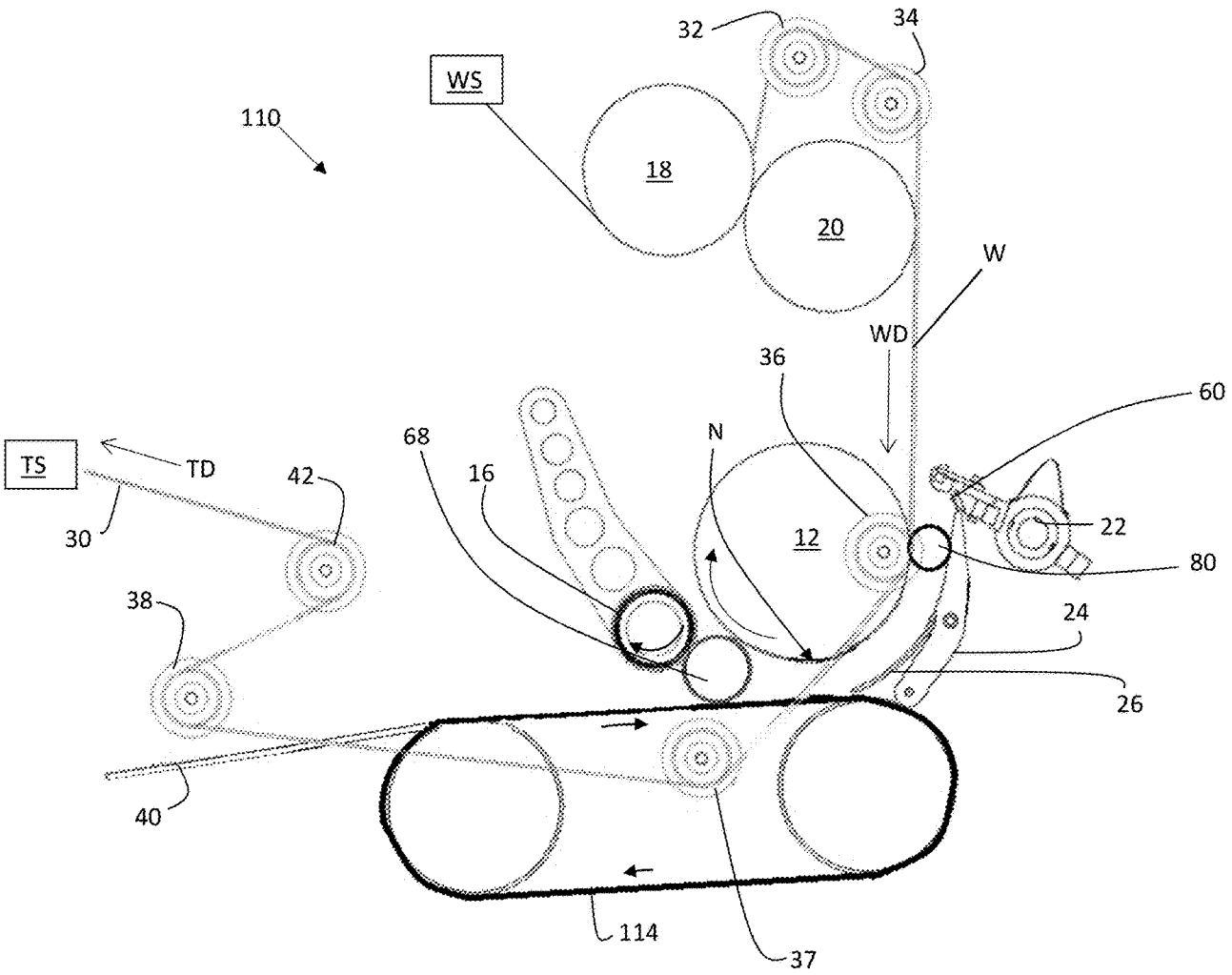
FIG. 13 shows a partial view of an exemplary winding nest where winding continues until the main portion of the web is drawn to the winding nest at which time the rider roll moves to the normal operating position to finish winding of the thread-up core and to begin normal web winding operations.

Winding the thread-up core 68 between the belt 114 and the winding drum 12 may continue until the full width of the web W is drawn into the winding nest N. Normal operation of the winding system may then be initiated. As shown in FIG. 13, a successive core 80 may be inserted into the winding nest N from the core feeder 22 to begin normal winding operations. The thread-up core 68 may be removed after the successive core 80 is inserted into the winding nest N. Accordingly, in one aspect of operation of the winding system, inserting the successive core 80 into the winding nest N from the core feeder 22 to begin normal winding operations occurs when a full width of the web material W from the web supply WS is present across the winding nest N. In the transition from threading operations to normal winding operations when the nip is formed between the belt 114 and the winding drum 12, the rider roll 16 may be moved to a position relative to the winding drum 12 and the belt to allow the winding drum and belt to rotate the thread-up core 68 to wind the excess portion 64 of the web material W around the thread-up core and to wind the web material from the supply WS of web material around the thread-up core. When the rider roll 16 moves to the position relative to the winding drum 12 and the belt 114 to allow the thread-up core 68 to wind the excess portion 64 of the web material W around the thread-up core and to wind the web material from the supply WS of web material around the thread-up core, the rider roll may configured to rotate in a direction different from the direction when passing the excess portion 64 of the web through the nip 60 of the rider roll and the belt. Once the excess portion 64 of the leading edge 50 of the web material passes through the nip 60 of the belt 114 and the rider roll 16, the rider roll may move to position for normal winding operations, where the log is wound between the winding drum, the belt, and the rider roll.

In another aspect of the method, the threading belt 30 may be operated to draw the leading edge 50 of the web material W through the winding nest N as described before. With the knot 52 of the leading edge 50 of the web material W in a desired position, the rider roll 16 may be brought into position with the belt 114 to form the nip 60 with the excess portion of the leading edge of the web material therebetween. The thread-up core 68 may be inserted by the core feeder 22 and rotated with the belt 114 and winding drum 12. With the belt 114 and rider roll 16 rotating, any excess portion 64 of the leading edge 50 of the web material W may be wound around the thread-up core 68. The web winding machine 10 may be operated intermittently to control the backwinding of the excess portion 64 of the leading edge 50 of the web material W around the thread-up core 68. However, in distinction to the method described above where backwinding continues in order to separate the leading edge 50 of the web material W from the threading belt 30, backwinding may stop momentarily, and the threading belt 30 may be operated to pull the excess portion 64 of the leading edge 50 of the web material W taut with the nip 60 between the rider roll 16 and the belt 114 and to cause the leading edge of the web material to separate from the threading belt. Separation of the leading edge 50 of the web material W from the threading belt 30 may include tearing the web adjacent to the knot 52 or may include pulling the knot away from the threading belt so the knot is wound around the thread-up core. The actuator 70 may be operated before operating the threading belt 30 to spread open the hole 51 in the threading belt to allow the knot to slip through the hole once the actuator is retracted and operation of the threading belt restarts. The actuator 70 may also be operated before operating the threading belt 30 to engage the knot 51 and force at least a portion of the knot through the hole 51 in the threading belt before operation of the threading belt restarts. Once the separating of the leading edge 50 of the web material W from the threading belt 30 occurs, operation of the threading belt may stop and rotation of the thread-up core 68 may resume to wind the excess portion 64 of the web material W around the thread-up core and to draw the web material W into the winding nest from the web supply WS.

Thereafter, a successive core 80 may be inserted into the winding nest from the core feeder to begin normal winding operations. The thread-up core may be separated from the web and removed after the successive core is inserted into the winding nest. As discussed above, normal winding operations may begin when a full width of the web material from the web supply is present in the winding nest.

As various modifications could be made in the constructions and methods herein described without departing from the scope of the invention, it is intended that all matter contained in the foregoing description and shown in the accompanying drawings shall be interpreted as illustrative and not as limiting. The breadth and scope the present invention should not be limited by any of the above described exemplary embodiments.

What is claimed is:

1. A method for initiating a web winding process from a stopped state to a running state, the method comprising the steps of:

providing a web winding system, wherein the web winding system comprises a first winding drum and a second winding drum, the first winding drum and the second winding drum in part define a winding nest of the web winding system, and further comprising a core feeder adapted and configured to insert a core into the winding nest, wherein the web winding system is adapted and configured to wind in the winding nest about a core received from the core feeder a web material from a supply of web material into a convoluted roll of web material;

engaging a leading edge of the web material from the supply of web material with a threading belt;

operating the threading belt to draw the leading edge of the web material through the web winding system in a direction corresponding to a path of the web material during normal operation of the winding system, including directing the web material around the first winding drum and through the winding nest to a position where the leading edge of the web material is beyond a position where the core feeder inserts the core into the winding nest to provide an excess portion of the web material between the leading edge of the web material and the core feeder core insertion position;

inserting a thread-up core into the winding nest from the core feeder;

imparting rotation to the thread-up core with the second winding drum and the first winding drum in a manner so that the excess portion moves toward and around the thread-up core, the leading edge of the web material is separated from the threading belt, the excess portion of the web material is wound around the thread-up core, and the web material from the supply of web material is wound around the thread-up core; and discontinuing operation of the threading belt.

2. The method of claim 1 wherein the step of engaging the leading edge of the web material from the supply of web material with the threading belt includes forming a knot in the web that is engaged by the threading belt.

3. The method of claim 2 wherein the step of imparting rotation to the thread-up core with the second winding drum and the first winding drum includes tearing the web adjacent to the knot.

4. The method of claim 2 wherein the step of imparting rotation to the thread-up core with the second winding drum and the first winding drum includes pulling the knot away from the threading belt and winding the knot with the excess portion of the web material around the thread-up core while winding the web material from the supply of web material around the thread-up core.

5. The method of claim 1 further comprising inserting a successive core into the winding nest from the core feeder to begin normal winding operations.

6. The method of claim 5, further comprising removing the thread-up core after the successive core is inserted into the winding nest.

7. The method of claim 5 wherein the step of inserting the successive core into the winding nest from the core feeder to begin normal winding operations occurs when a full width of the web material from the web supply is present across the winding nest.

8. The method of claim 1 further comprising providing a rider roll in the winding nest.

9. The method of claim 8 further comprising forming a nip between the rider roll and the second winding drum with the web material between the rider roll and the second winding drum before imparting rotation to the thread-up core with the second winding drum and the first winding drum.

10. The method of claim 9 further comprising rotating the rider roll relative to the second winding drum with the excess portion passing through the nip of the rider roll and the second winding drum.

11. The method of claim 10 further comprising moving the rider roll to a position relative to the first winding drum and the second winding drum to allow the winding drums to rotate the thread-up core to wind the excess portion of the web material around the thread-up core and to wind the web material from the supply of web material around the thread-up core.

12. The method of claim 11 wherein the step of moving the rider roll to the position relative to the first and second winding drums to allow the thread-up core to wind the excess portion of the web material around the thread-up core occurs after the excess portion of the web passes through the nip of the rider roll and the second winding drum.

13. The method of claim 10 wherein the step of rotating the second winding drum and rider roll in a manner so that the excess portion moves toward and around the thread-up core includes rotating the rider roll in a direction opposite to rotation of the rider roll during normal operations.

14. The method of claim 10 wherein the step of rotating the second winding drum and the rider roll in a manner so that the excess portion moves toward and around the thread-up core includes intermittently operating the winding system to draw the slack of the excess portion through the nip formed between the rider roll and the second winding drum.

15. The method of claim 1 wherein the step of imparting rotation to the thread-up core with the second winding drum and the first winding drum to separate the leading edge of the web material from the threading belt includes intermittently operating the winding system to impart rotation to the thread-up core with the second winding drum and the first winding drum.

16. The method of claim 1 wherein step of the operating the threading belt to draw the leading edge of the web material through the web winding system in the direction corresponding to the path of the web material during normal operation of the winding system and in a manner to direct the web material around the first winding drum and through the winding nest to the position where the leading edge of the web material is beyond the position where the core feeder inserts the core into the winding nest and to provide the excess portion of the web material between the leading edge of the web material and the core feeder core insertion position includes directing the excess portion of the web material away from and then back towards the winding nest to create slack in the excess portion.

17. The method of claim 1 further comprising applying a bonding agent to an exterior surface of the thread-up core.

18. The method of claim 17 wherein the step of applying the bonding agent to the exterior surface of the thread-up core includes applying the bonding agent to the area of the core to be wound with the excess portion of the web material.

19. The method of claim 17 wherein the step of applying a bonding agent includes applying an adhesive to the exterior surface of the thread-up core.

20. The method of claim 19 wherein normal operation of the winding system is initiated after a full width of the web material from the web supply is present across the winding nest and separated from the thread-up core.

21. The method of claim 1 wherein the leading edge of the web material is acutely angled relative to the length of the web.

22. The method of claim 1 wherein the threading belt has an opening configured to engage the leading edge of the web material; and the method further comprises spreading the opening in the threading belt to facilitate separation of the leading edge of the web material from the threading belt.

23. The method of claim 22 wherein the step of spreading the opening includes directing an operator into the opening of the threading belt.

24. A method for initiating a web winding process from a stopped state to a running state, the method comprising the steps of:

providing a web winding system, wherein the web winding system comprises a first winding drum, a second winding drum, and a rider roll which in part define a winding nest of the web winding system, and a core feeder adapted and configured to insert a core into the winding nest, wherein the web winding system is adapted and configured to wind in the winding nest about a core received from the core feeder a web material from a supply of web material;

engaging a leading edge of the web material from the supply of web material with a threading belt;

operating the threading belt to draw the leading edge of the web material through the web winding system in a direction corresponding to a path of the web material during normal operation of the winding system and in a manner to direct the web material around the first winding drum and through the winding nest to a position where the leading edge of the web material is beyond a position where the core feeder inserts the core into the winding nest and to provide an excess portion of the web material between the leading edge of the web material and the core feeder core insertion position;

inserting a thread-up core into the winding nest from the core feeder;

forming a nip between the rider roll and the second winding drum with the web material between the rider roll and the second winding drum;

operating the threading belt to draw the excess portion of the web material away from the nip of the second winding drum and rider roll so as to separate the leading edge of the web material from the threading belt;

rotating the second winding drum and rider roll in a manner so that the excess portion moves toward and around the thread-up core;

imparting rotation to the thread-up core with the second winding drum and the first winding drum to wind the excess portion of the web material around the thread-up core and to wind the web material from the supply of web material around the thread-up core; and discontinuing operation of the threading belt.

25. The method of claim 24 wherein the step of engaging the leading edge of the web material from the supply of web material with the threading belt includes forming a knot in the web that is engaged by the threading belt.

26. The method of claim 25 wherein the step of operating the threading belt to draw the excess portion of the web material away from the nip of the second winding drum and the rider roll so as to separate the leading edge of the web material from the threading belt includes tearing the web adjacent to the knot.

27. The method of claim 25 wherein the step of operating the threading belt to draw the excess portion of the web material away from the nip of the second winding drum and the rider roll so as to separate the leading edge of the web material from the threading belt includes pulling the knot away from the threading belt.

28. The method of claim 24 further comprising inserting a successive core into the winding nest from the core feeder to begin normal winding operations.

29. The method of claim 28 further comprising removing the thread-up core after the successive core is inserted into the winding nest.

30. The method of claim 29 wherein the step of inserting the successive core into the winding nest from the core feeder to begin normal winding operations occurs when a full width of the web material from the web supply is present in the winding nest.

31. The method of claim 24 further comprising moving the rider roll to a position relative to the first and second winding drums to allow the thread-up core to wind the excess portion of the web material around the thread-up core and to wind the web material from the supply of web material around the thread-up core.

32. The method of claim 31 wherein the step of moving the rider roll to the position relative to the first and second winding drums to allow the thread-up core to wind the excess portion of the web material around the thread-up core occurs after the excess portion of the web passes through the nip of the rider roll and the second winding drum.

33. The method of claim 24 wherein the step of operating the threading belt to draw the excess portion of the web material away from the nip of the second winding drum and rider roll so as to separate the leading edge of the web material from the threading belt includes rotating the second winding drum and the rider roll in a manner so that the excess portion moves toward and around the thread-up core.

34. The method of claim 33 wherein the step of rotating the second winding drum and the rider roll in a manner so that the excess portion moves toward and around the thread-up core includes rotating the rider roll in a direction of opposite rotation of the rider roll during normal operations.

35. The method of claim 33 wherein the step of rotating the second winding drum and the rider roll in a manner so that the excess portion moves toward and around the thread-up core includes rotating the rider roll relative to the second winding drum with the excess portion passing through the nip of the rider roll and the second winding drum.

36. The method of claim 33 wherein the step of rotating the second winding drum and the rider roll in a manner so that the excess portion moves toward and around the thread-up core includes intermittently operating the winding system to impart rotation to the thread-up core with the second winding drum and the first winding drum.

37. The method of claim 24 wherein step of the operating the threading belt to draw the leading edge of the web material through the web winding system in the direction corresponding to the path of the web material during normal operation of the winding system and to direct the web material around the first winding drum and through the winding nest to the position where the leading edge of the web material is beyond the position where the core feeder inserts the core into the winding nest and to provide the excess portion of the web material between the leading edge of the web material and the core feeder core insertion position includes directing the leading edge of the web material away from and then back towards the winding nest to create slack in the excess portion.

38. The method of claim 37 wherein the step of rotating the second winding drum and the rider roll in a manner so that the excess portion moves toward and around the thread-up core includes intermittently operating the winding system to draw the slack of the excess portion through the nip of the rider roll and the second winding drum.

39. The method of claim 24 further comprising applying a bonding agent to an exterior surface of the thread-up core.

40. The method of claim 39 wherein the step of applying the bonding agent to the exterior surface of the thread-up core includes applying the bonding agent to the area of the core to be wound with the excess portion of the web material.

41. The method of claim 39 wherein the step of applying a bonding agent includes applying an adhesive to the exterior surface of the thread-up core.

42. The method of claim 41 wherein the step of applying a bonding agent includes applying an adhesive to the exterior surface of the thread-up core.

43. The method of claim 24 wherein the leading edge of the web material is acutely angled relative to the length of the web.

44. The method of claim 24 wherein the threading belt has an opening configured to engage the leading edge of the web material; and the method further comprises spreading the opening in the threading belt before operating the threading belt to draw the excess portion of the web material away from the nip of the second winding drum and rider roll.

45. The method of claim 44 wherein the step of spreading the opening includes directing an operator into the opening of the threading belt.

* * * * *